US011120741B2

(12) United States Patent
Umezawa

(10) Patent No.: US 11,120,741 B2
(45) Date of Patent: Sep. 14, 2021

(54) DISPLAY DEVICE AND METHOD FOR DRIVING SAME

(71) Applicant: SHARP KABUSHIKI KAISHA, Osaka (JP)

(72) Inventor: Seiji Umezawa, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/059,389

(22) PCT Filed: Jul. 4, 2018

(86) PCT No.: PCT/JP2018/025309
§ 371 (c)(1),
(2) Date: Nov. 27, 2020

(87) PCT Pub. No.: WO2020/008546
PCT Pub. Date: Jan. 9, 2020

(65) Prior Publication Data
US 2021/0158754 A1 May 27, 2021

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2310/0202* (2013.01); *G09G 2320/0233* (2013.01)

(58) Field of Classification Search
CPC .. G09G 3/3233; G09G 3/3266; G09G 3/3275; G09G 2310/0202; G09G 2320/0233
USPC ..... 345/112
See application file for complete search history.

(56) References Cited

U.S. PATENT DOCUMENTS

2012/0001896 A1* 1/2012 Han ..... G09G 3/3233 345/214

FOREIGN PATENT DOCUMENTS

JP 2013-057701 A 3/2013

* cited by examiner

*Primary Examiner* — Amare Mengistu
*Assistant Examiner* — Gloryvid Figueroa-Gibson
(74) *Attorney, Agent, or Firm* — ScienBiziP, P.C.

(57) ABSTRACT

The present application discloses a current-driven display device which employs internal compensation, by which a non-emission period can be shortened without causing the luminance of display elements to be unstable. During a period in which a voltage on a data signal line Dj is written to a pixel circuit, transistors M4 and M6 are controlled to be in an OFF state, and transistors M2, M3, and M5 are controlled to be in an ON state. As a result, a drive transistor M1 is diode-connected, a source terminal thereof is disconnected from a high-level power line ELVDD, and a gate terminal thereof and an anode of an organic EL element OLED are connected to an initialization voltage supply line Vini. Consequently, a gate voltage Vg of the drive transistor M1 and an anode voltage Va of the organic EL element OLED are initialized, and first and second capacitors C1 and C2 respectively hold a voltage corresponding to the voltage on the data signal line Dj and a threshold voltage of the drive transistor M1.

16 Claims, 8 Drawing Sheets

FIG. 10

| | Charge Amount of C1 | Charge Amount of C2 | Charge Amount of Node G |
|---|---|---|---|
| End of Initialization/writing Period | C1 (Vini−Vdata) | −C2 \|Vth\| | C1 (Vini−Vdata) −C2 \|Vth\| |
| Emission Period | C1 (Vout−Vsus) | C2 (Vout−ELVDD) | C1 (Vout−Vsus) +C2 (Vout−ELVDD) |

DISPLAY DEVICE AND METHOD FOR DRIVING SAME

TECHNICAL FIELD

The disclosure relates to display devices, more specifically to a current-driven display device, such as an organic EL (electro-luminescent) display device, which is provided with display elements to be driven by currents, and also relates to a method for driving the same.

BACKGROUND ART

In recent years, organic EL display devices provided with pixel circuits which include organic EL elements (also referred to as organic light-emitting diodes (OLEDs)) have been put into practical use. In addition to the organic EL elements, the pixel circuits in the organic EL display devices include drive transistors, write control transistors, holding capacitors, etc. As the drive transistors and the write control transistors, thin-film transistors are used, and the drive transistors are connected at gate terminals, which serve as control terminals, to the holding capacitors, to which drive circuits supply data voltages via data signal lines; the data voltages are voltages corresponding to video signals that represent images to be displayed (more specifically, voltages that specify gradation values for pixels to be formed by the pixel circuits). The organic EL elements are self-luminous display elements which emit light with luminances corresponding to currents flowing therethrough. The drive transistors are provided in series with the organic EL elements and configured to control the currents flowing through the organic EL elements in accordance with voltages held by the holding capacitors.

The organic EL elements and the drive transistors are susceptible to variations and shifts in characteristics. Accordingly, in order for the organic EL display devices to achieve high-quality image display, it is necessary to compensate for such variations and shifts in element characteristics. For the organic EL display device, there are known methods for compensating for element characteristics; in one method, element characteristics compensation is performed in pixel circuits, and in another method, element characteristics compensation is performed outside pixel circuits. In known pixel circuits compatible with the former method, voltages on gate terminals of drive transistors, i.e., voltages that are held by holding capacitors, are initialized, and thereafter the holding capacitors are charged with data voltages via the drive transistors in diode connection. In such pixel circuits, variations and shifts in threshold voltage of the drive transistors are internally compensated for (hereinafter, such compensation for variations and shifts in threshold voltage will be referred to as "threshold compensation").

For example, Patent Document 1 includes descriptions related to an organic EL display device compatible with the method in which threshold compensation is performed in pixel circuits, as described above, (hereinafter, this method will be referred to as "internal compensation"). More specifically, Patent Document 1 discloses some pixel circuits which are configured such that voltages on gate terminals of drive transistors, i.e., voltages that are held by holding capacitors, are initialized to a predetermined level, and thereafter the holding capacitors are charged with data voltages via drive transistors in diode connection.

Furthermore, Patent Document 2 describes a configuration relevant to a pixel circuit in an organic EL display device as disclosed herein. The display device disclosed in Patent Document 2 includes a pixel circuit configured such that a drive transistor TDR for generating a drive current for a light-emitting element E is connected at a gate terminal to a signal line 14 sequentially through a first capacitive element C1 and a selection transistor QSL and also to a potential line for a drive potential VEL via a second capacitive element C2, whereby the operation of writing a gradation potential VX[n] can be performed simultaneously with the operation of initializing a gate potential VG of the drive transistor TDR (see FIGS. 3, 10, and 11 and paragraphs [0042] to [0044] of the patent document).

CITATION LIST

Patent Documents

Patent Document 1: US 2012/0001896 A1
Patent Document 2: JP 2013-57701 A

SUMMARY

Technical Problem

As in the case of the pixel circuit of the organic EL display device that employs internal compensation described in Patent Document 1, when voltages on gate terminals of drive transistors are initialized, and thereafter holding capacitors are charged with data voltages via the drive transistors in diode connection (see FIG. 2 to be described later), each pixel circuit is controlled such that an organic EL element emits no light not only during a data write period for the pixel circuit (i.e., a period in which the holding capacitors are being charged with the data voltages) but also during a preceding initialization period, with the result that no light is emitted at least during both periods (see FIG. 3 to be described later).

On the other hand, in the case of the display device described in Patent Document 2, the initialization of the voltage on the gate terminal of the drive transistor TDR in each pixel circuit is performed simultaneously with data write (see FIGS. 4 to 6 to be described later), and therefore, when compared to the display device in Patent Document 1, the period during which no light is emitted (non-emission period) can be shortened for each pixel circuit. However, in the case of this pixel circuit, the discharging of parasitic capacitance in the light-emitting element E, which serves as a display element, (hereinafter, such discharging will be referred to as "display element initialization") cannot be performed simultaneously with data writing. Accordingly, display element initialization is performed during an emission period, with the result that the luminance of the display element might become unstable during the emission period.

Therefore, it is desired to shorten the non-emission period for the current-driven display device that employs internal compensation, without causing reduced display quality such as unstable display element luminances.

Solution to Problem

Several embodiments of the disclosure provide a display device having a plurality of data signal lines, a plurality of scanning signal lines crossing the data signal lines, a plurality of emission control lines corresponding to the respective scanning signal lines, and a plurality of pixel circuits arranged in a matrix along the data signal lines and the scanning signal lines, the device comprising:

first and second power lines;

an initialization voltage supply line;

a reference voltage supply line;

a data signal line drive circuit configured to drive the data signal lines;

a scanning signal line drive circuit configured to selectively drive the scanning signal lines; and an emission control circuit configured to drive the emission control lines, wherein, each pixel circuit includes:

a display element driven by a current;

first and second capacitors;

a drive transistor configured to control the drive current of the display element in accordance with voltages held by the first and second capacitors; and an emission control switching element, the drive transistor is connected at a first conduction terminal to the first power line via the emission control switching element, the drive transistor is connected at a second conduction terminal to a first terminal of the display element, the drive transistor is connected at a control terminal to the first conduction terminal via the second capacitor and to a first terminal of the first capacitor, the display element is connected at a second terminal to the second power line, each pixel circuit corresponds to one of the data signal lines and one of the scanning signal lines, and each pixel circuit is configured such that upon writing of a voltage on the corresponding data signal line to the pixel circuit, the emission control switching element is controlled to be in an OFF state, and in response to selection of the corresponding scanning signal line, a second terminal of the first capacitor is supplied with the voltage on the corresponding data signal line, and the control terminal of the drive transistor and the first terminal of the display element are supplied with a voltage on the initialization voltage supply line.

Several other embodiments of the disclosure provide a method for driving a display device having a plurality of data signal lines, a plurality of scanning signal lines crossing the data signal lines, a plurality of emission control lines corresponding to the respective scanning signal lines, first and second power lines, an initialization voltage supply line, a reference voltage supply line, and a plurality of pixel circuits arranged in a matrix along the data signal lines and the scanning signal lines, wherein, each pixel circuit corresponds to one of the data signal lines and one of the scanning signal lines, and each pixel circuit includes a display element driven by a current, first and second capacitors, a drive transistor configured to control the drive current of the display element in accordance with voltages held by the first and second capacitors, and an emission control switching element, the drive transistor is connected at a first conduction terminal to the first power line via the emission control switching element, the drive transistor is connected at a second conduction terminal to a first terminal of the display element, the drive transistor is connected at a control terminal to the first conduction terminal via the second capacitor and to a first terminal of the first capacitor, the display element is connected at a second terminal to the second power line, and the method comprises a data writing step of, upon writing of a voltage on a corresponding data signal line to each pixel circuit, controlling the emission control switching element in the pixel circuit to be in an OFF state, supplying the voltage on the corresponding data signal line to a second terminal of the first capacitor, and supplying a voltage on the initialization voltage supply line to the control terminal of the drive transistor and the first terminal of the display element.

Effect of the Disclosure

In each pixel circuit in the above embodiments of the disclosure, the first conduction terminal of the drive transistor is connected to the first power line via the emission control switching element, the second conduction terminal of the drive transistor is connected to the first terminal of the display element, the control terminal of the drive transistor is connected to the first conduction terminal via the second capacitor and to the first terminal of the first capacitor, and the second terminal of the display element is connected to the second power line. For each pixel circuit as above, when a voltage on a data signal line corresponding thereto is written to the pixel circuit, the emission control switching element in the pixel circuit is controlled to be in an OFF state thereby electrically disconnecting the first conduction terminal of the drive transistor from the first power line, the second terminal of the first capacitor is supplied with the voltage on the corresponding data signal line, and the control terminal of the drive transistor and the first terminal of the display element are supplied with a voltage on the initialization voltage supply line. Accordingly, the control terminal of the drive transistor and the first terminal of the display element are initialized to the voltage on the initialization voltage supply line, and the first capacitor holds a voltage corresponding to a difference between the voltage on the corresponding data signal line and the voltage on the initialization voltage supply line. Moreover, with the first conduction terminal of the drive transistor being electrically disconnected from the first power line, the control terminal and the second conduction terminal of the drive transistor are connected to the initialization voltage supply line, and therefore, if the second capacitor holds a voltage higher than the absolute value |Vth| of the threshold voltage of the drive transistor, the voltage being held by the second capacitor becomes equal to the value |Vth| as a result of charge flowing out of the second capacitor. In this manner, for each pixel circuit, when the voltage on the corresponding data signal line is written to the pixel circuit, the gate terminal of the drive transistor and the first terminal of the display element in the pixel circuit are initialized simultaneously, and at the same time, the second capacitor is discharged in order to (perform threshold compensation and thereby) inhibit the drive current of the display element from being affected by variations and shifts in the threshold voltage. Thus, the above embodiments of the disclosure render it possible to shorten the non-emission period for the current-driven display device while performing internal compensation without causing reduced display quality such as unstable display element luminances.

BRIEF DESCRIPTION OF THE DRAWINGS

FIG. 10 is a table listing the amounts of charge in components of the pixel circuit in the first embodiment.

DESCRIPTION OF EMBODIMENTS

Hereinafter, embodiments will be described with reference to the accompanying drawings. It should be noted that in each transistor to be mentioned below, a gate terminal thereof serves as a control terminal, and drain and source terminals thereof serve as first and second conduction terminals, respectively, or vice versa. Moreover, in the following embodiments, all transistors will be described as P-channel transistors, but the disclosure is not limited to this. Further, in the following embodiments, the transistors are, for example, thin-film transistors, but the disclosure is not limited to this. Still further, unless otherwise specified, the term "connection" as used herein is intended to mean "electrical connection" regardless of whether the connection is made directly or indirectly via another element without departing from the scope of the disclosure.

<1. Overall Configuration>

Figure 1:
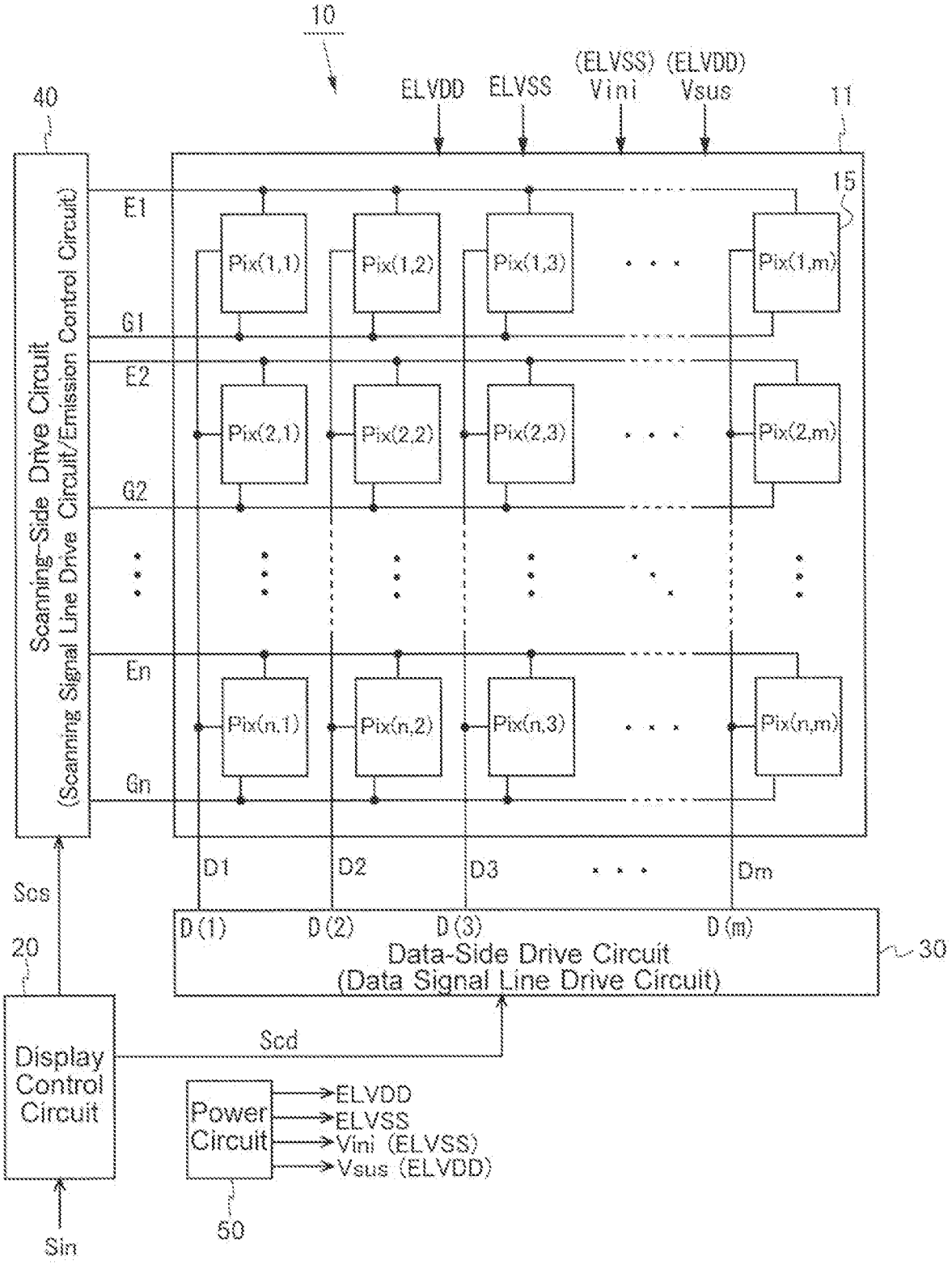
FIG. 1 is a block diagram illustrating an overall configuration of a display device according to a first embodiment.

FIG. 1 is a block diagram illustrating an overall configuration of an organic EL display device 10 according to a first embodiment. The display device 10 is an organic EL display device which performs internal compensation. Accordingly, in the display device 10, each pixel circuit has the function of compensating for variations and shifts in threshold voltage of drive transistors included therein (details will be described later).

As shown in FIG. 1, the display device 10 includes a display portion 11, a display control circuit 20, a data-side drive circuit 30, a scanning-side drive circuit 40, and a power circuit 50. The data-side drive circuit functions as a data signal line drive circuit (also referred to as a "data driver"). The scanning-side drive circuit 40 functions as a scanning signal line drive circuit (also referred to as a "gate driver") and also as an emission control circuit (also referred to as an "emission driver"). In the configuration shown in FIG. 1, these two drive circuits are achieved as one scanning-side drive circuit 40 but may be suitably separated as individual circuits or separately arranged on opposite sides across the display portion 11. Moreover, the scanning-side drive circuit and the data signal line drive circuit may be at least in part integrally formed with the display portion 11. These similarly apply to other embodiments and variants to be described later. The power circuit 50 generates a high-level supply voltage ELVDD, a low-level supply voltage ELVSS, an initialization voltage Vini, and a reference voltage Vsus, which are to be supplied to the display portion 11, as will be described below, and the power circuit 50 also generates a supply voltage (not shown) to be supplied to the display control circuit 20, the data-side drive circuit 30, and the scanning-side drive circuit 40.

The display portion 11 is provided with m (where m is an integer of two or more) data signal lines D1 to Dm and n (where n is an integer of two or more) scanning signal lines G1 to Gn crossing the data signal lines, and also includes n emission control lines (also referred to as "emission lines") E1 to En provided along the n respective scanning signal lines G1 to Gn. Moreover, the display portion 11 is provided with m×n pixel circuits 15 arranged in a matrix along the m data signal lines D1 to Dm and the n scanning signal lines G1 to Gn, as shown in FIG. 1, and each pixel circuit 15 corresponds to one of the m data signal lines D1 to Dm and one of the n scanning signal lines G1 to Gn (to distinguish each pixel circuit 15 from the others, the pixel circuit that corresponds to the i'th scanning signal line Gi and the j'th data signal line Dj will also be referred to below as the "i'th-row, j'th-column pixel circuit" and denoted by the symbol "Pix(i,j)"). The n emission control lines E1 to En correspond to the n respective scanning signal lines G1 to Gn. Accordingly, each pixel circuit 15 also corresponds to one of the n emission control lines E1 to En.

Moreover, the display portion 11 includes unillustrated power lines shared among the pixel circuits 15. More specifically, there is a power line for supplying a high-level supply voltage ELVDD to drive organic EL elements to be described later (this power line will be referred to below as the "high-level power line" and denoted by the same symbol as the high-level supply voltage, i.e., "ELVDD"), and there is also a power line for supplying a low-level supply voltage ELVSS to drive the organic EL elements (this power line will be referred to below as the "low-level power line" and denoted by the same symbol as the low-level supply voltage, i.e., "ELVSS"). Further, the display portion 11 includes an unillustrated initialization voltage supply line provided for supplying an initialization voltage (fixed voltage) Vini to be used for a reset operation (also referred to as an "initialization operation") for initializing each pixel circuit 15 (this line will be denoted by the same symbol as the initialization voltage, i.e., "Vini"), and the display portion 11 also includes an unillustrated reference voltage supply line provided for supplying a reference voltage Vsus to drive the pixel circuit 15 during an emission period (this line will be denoted by the same symbol as the reference voltage, i.e., "Vsus"). The high-level supply voltage ELVDD, the low-level supply voltage ELVSS, the initialization voltage Vini, and the reference voltage Vsus are supplied by the power circuit 50.

The display control circuit 20 receives an input signal Sin, which includes image information representing an image to be displayed and timing control information for image display, from outside the display device 10, generates a data control signal Scd and a scanning control signal Scs on the basis of the input signal Sin, and outputs the data control signal Scd to the data-side drive circuit (data signal line drive circuit) 30 and the scanning control signal Scs to the scanning-side drive circuit (scanning signal line drive circuit/emission control circuit) 40.

The data-side drive circuit 30 drives the data signal lines D1 to Dm in accordance with the data control signal Scd from the display control circuit 20. More specifically, in accordance with the data control signal Scd, the data-side drive circuit 30 outputs m data signals D(1) to D(m), which represent the image to be displayed, in parallel to the respective data signal lines D1 to Dm.

The scanning-side drive circuit 40 functions as a scanning signal line drive circuit for driving the scanning signal lines G1 to Gn and also as an emission control circuit for driving the emission control lines E1 to En, in accordance with the scanning control signal Scs from the display control circuit 20. More specifically, in accordance with the scanning control signal Scs, the scanning-side drive circuit 40 serving as the scanning signal line drive circuit sequentially selects the scanning signal lines G1 to Gn for a predetermined time period each in every frame period, the predetermined time period corresponding to one horizontal period, and applies an active signal (low-level voltage) to the scanning signal line Gk that is selected and inactive signals (high-level voltages) to the scanning signal lines that are not selected. As a result, m pixel circuits Pix(k,1) to Pix(k,m) corresponding to the scanning signal line Gk that is selected (where $1 \leq k \leq n$) are collectively selected. Consequently, during the period for which the scanning signal line Gk is selected (referred to below as the "k'th scanning selection period"), voltages of the m data signals D(1) to D(m) applied to the data signal lines D1 to Dm by the data-side drive circuit 30 (these voltages will also be simply referred to below as the "data voltages" without distinction) are written to the respective pixel circuits Pix(k,1) to Pix(k,m) as pixel data.

Furthermore, in accordance with the scanning control signal Scs, the scanning-side drive circuit 40 serving as the emission control circuit applies an emission control signal (high-level voltage) that designates "non-emission" to the i'th emission control line Ei during the i'th horizontal period and an emission control signal (low-level voltage) that designates "emission" to the i'th emission control line Ei during other periods (see FIG. 8 to be described later). While the voltage on the emission control line Ei is at low level, organic EL elements in pixel circuits (also referred to below as "i'th row pixel circuits") Pix(i,1) to Pix(i,m) corresponding to the i'th scanning signal line Gi emit light with luminances corresponding to data voltages respectively written to the i'th row pixel circuits Pix(i,1) to Pix(i,m).

<2. Configuration, Operation, and Problems of the Pixel Circuit in the First Known Example>

Before describing the configuration and operation of the pixel circuit 15 in the present embodiment, the configuration and operation of a pixel circuit to be compared with the pixel circuit 15, specifically, a pixel circuit 15*a* in a known organic EL display device (referred to below as a "first known example"), will be described below with reference to FIGS. 2 and 3. The overall configuration of the first known example is basically the same as the configuration shown in FIG. 1, but differs in the following points. Specifically, in the first known example, the display portion 11 includes a zeroth scanning signal line G0 provided along with the n scanning signal lines G1 to Gn, and the scanning-side drive circuit 40 serving as the scanning signal line drive circuit sequentially selects the scanning signal lines G0 to Gn during each frame period in accordance with a scanning control signal Scs. Moreover, in accordance with the scanning control signal Scs, the scanning-side drive circuit 40 serving as the emission control circuit applies an emission control signal (high-level voltage) that designates "non-emission" to the i'th emission control line Ei during the (i−1)'th and i'th horizontal periods and an emission control signal (low-level voltage) that designates "emission" during other periods (see FIG. 3).

Figure 2:
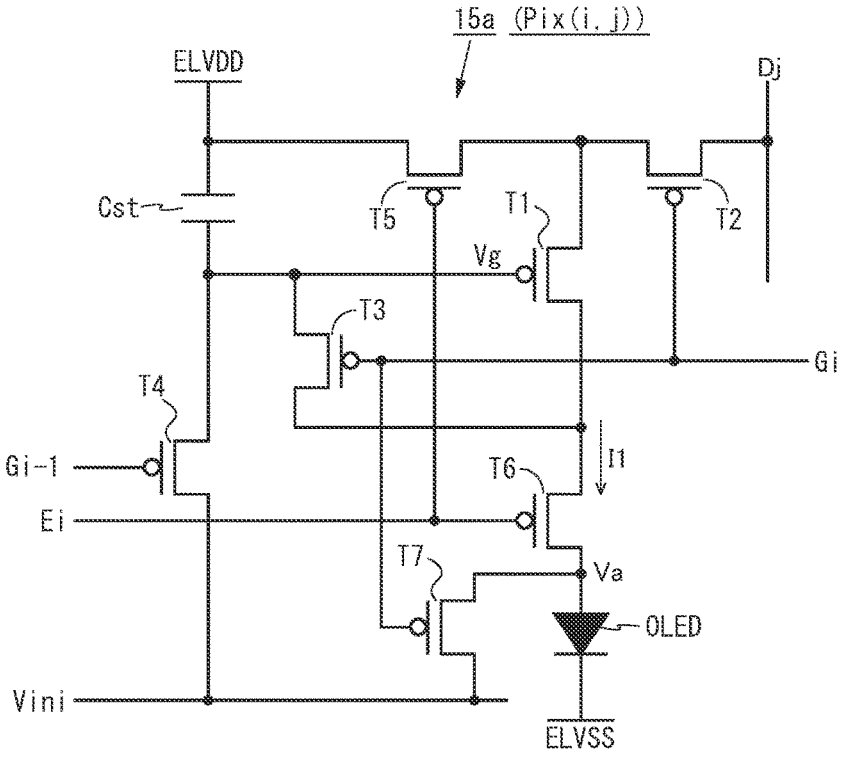
FIG. 2 Prior Art
FIG. 2 is a circuit diagram illustrating a configuration of a pixel circuit in a known display device (first known example).

FIG. 2 is a circuit diagram illustrating the configuration of a pixel circuit 15*a* in the first known example, more specifically, a pixel circuit 15*a* corresponding to the i'th scanning signal line Gi and the j'th data signal line Dj, i.e., the circuit diagram illustrates the configuration of the i'th-row, j'th-column pixel circuit Pix(i,j) (where $1 \leq i \leq n$, and $1 \leq j \leq m$). As shown in FIG. 2, the pixel circuit 15*a* includes an organic EL element OLED, which serves as a display element, a drive transistor T1, a write control transistor T2, a threshold compensation transistor T3, a first initialization transistor T4, a first emission control transistor T5, a second emission control transistor T6, a second initialization transistor T7, and a holding capacitor Cst. In the pixel circuit 15*a*, the transistors T2 to T7, i.e., all the transistors excluding the drive transistor T1, function as switching elements.

The pixel circuit 15*a* is connected to a scanning signal line Gi corresponding thereto (also referred to below as a "corresponding scanning signal line" in descriptions focusing on the pixel circuit), a scanning signal line Gi−1 immediately preceding the corresponding scanning signal line Gi (this scanning signal line immediately precedes in order of scanning among the scanning signal lines G1 to Gn and will also be referred to below as the "preceding scanning signal line" in descriptions focusing on the pixel circuit), an emission control line Ei corresponding to the pixel circuit (also referred to below as a "corresponding emission control line" in descriptions focusing on the pixel circuit), a data signal line Dj corresponding to the pixel circuit (also referred to below as a "corresponding data signal line" in descriptions focusing on the pixel circuit), an initialization voltage supply line Vini, a high-level power line ELVDD, and a low-level power line ELVSS.

In the pixel circuit 15*a*, the drive transistor T1 is connected at a source terminal to the corresponding data signal line Dj via the write control transistor T2 and also to the high-level power line ELVDD via the first emission control transistor T5, as shown in FIG. 2. The drive transistor T1 is connected at a drain terminal to an anode of the organic EL element OLED via the second emission control transistor T6. The drive transistor T1 is connected at a gate terminal to the high-level power line ELVDD via the holding capacitor Cst, to the drain terminal of the drive transistor T1 via the threshold compensation transistor T3, and to the initialization voltage supply line Vini via the first initialization transistor T4. The organic EL element OLED is connected at the anode to the initialization voltage supply line Vini via the second initialization transistor T7, and also connected at a cathode to the low-level power line ELVSS. Moreover, the write control transistor T2, the threshold compensation transistor T3, and the second initialization transistor T7 are connected at gate terminals to the corresponding scanning signal line Gi, the first and second emission control transistors T5 and T6 are connected at gate terminals to the corresponding emission control line Ei, and the first initialization transistor T4 is connected at a gate terminal to the preceding scanning signal line Gi−1.

The drive transistor T1 is operated in the saturation region, and the organic EL element OLED has a drive current I1, as given by equation (1) below, flowing therethrough during the emission period. Equation (1) includes a gain β of the drive transistor T1, which is given by equation (2) below.

$$I1 = (\beta/2)(|Vgs| - |Vth|)^2 = (\beta/2)(|Vg - ELVDD| - |Vth|^2) \quad (1)$$

$$\beta = \mu \times (W/L) \times Cox \quad (2)$$

In equations (1) and (2), Vth, μ, W, L, and Cox respectively represent a threshold voltage, a mobility, a gate width, a gate length, and a gate insulating film capacitance per unit area of the drive transistor T1.

Figure 3:
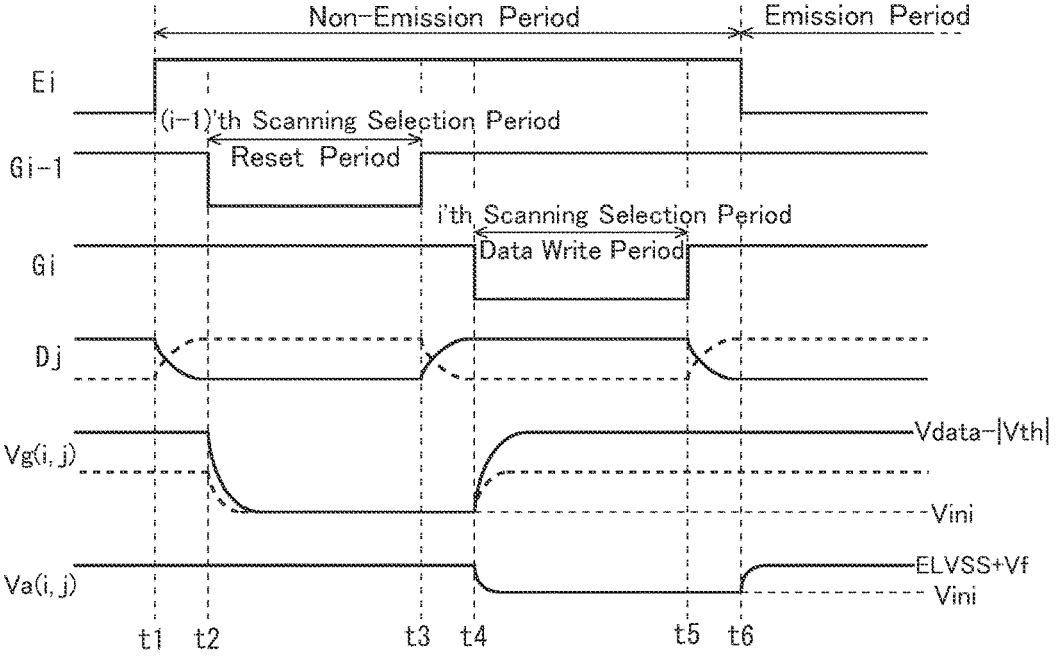
FIG. 3 Prior Art
FIG. 3 is a signal waveform diagram for describing the driving of the first known example.

FIG. 3 is a signal waveform diagram for describing the driving of the display device according to the first known example and showing changes in voltages on the signal lines (the corresponding emission control line Ei, preceding scanning signal line Gi−1, the corresponding scanning signal line Gi, and the corresponding data signal line Dj), the voltage Vg on the gate terminal of the drive transistor T1 (referred to below as the "gate voltage"), and the voltage Va on the anode of the organic EL element OLED (referred to below as the "anode voltage") during reset, data writing, and lighting operations of the pixel circuit 15*a* shown in FIG. 2, i.e., the i'th-row, j'th-column pixel circuit Pix(i,j). In FIG. 3, the period from time t1 to time t6 corresponds to a non-emission period for the i'th row pixel circuits Pix(i,1) to Pix(i,m). The period from time t2 to time t4 corresponds to the (i−1)'th horizontal period, and the period from time t2 to time t3 corresponds to a selection period for the (i−1)'th scanning signal line (preceding scanning signal line) Gi−1, i.e., the (i−1)'th scanning selection period. The (i−1)'th scanning selection period coincides with a reset period for the i'th row pixel circuits Pix(i,1) to Pix(i,m). The period from time t4 to time t6 corresponds to the i'th horizontal period, and the period from time t4 to time t5 corresponds to a selection period for the i'th scanning signal line (corresponding scanning signal line) Gi, i.e., the i'th scanning selection period. The i'th scanning selection period coincides with a data write period for the i'th row pixel circuits Pix(i,1) to Pix (i,m).

For the i'th-row, j'th-column pixel circuit Pix(i,j), once the voltage on the emission control line Ei is changed from low to high level at time t1, as shown in FIG. 3, the first and second emission control transistors T5 and T6 transition from an ON state to an OFF state, with the result that the organic EL element OLED is rendered in a non-emission state.

At time t2, the voltage on the preceding scanning signal line Gi−1 is changed from high to low level, with the result that the preceding scanning signal line Gi−1 is selected. Accordingly, the first initialization transistor T4 transitions to an ON state. Consequently, the voltage on the gate terminal of the drive transistor T1, i.e., the gate voltage Vg, is initialized to the initialization voltage Vini. The initialization voltage Vini is a voltage low enough to maintain the drive transistor T1 in an ON state while the data voltage is being written to the pixel circuit Pix (i,j).

The period from time t2 to time t3 corresponds to a reset period for the i'th row pixel circuits Pix(i,1) to Pix(i,m), and in the pixel circuit Pix(i,j), the gate voltage Vg is initialized during the reset period because the first initialization transistor T4 is in the ON state, as described earlier. FIG. 3 shows the change of the gate voltage Vg(i,j) on the pixel circuit Pix(i,j) during the period. It should be noted that the symbol "Vg(i,j)" is used to distinguish the gate voltage Vg of the pixel circuit Pix(i,j) from gate voltages Vg of other pixel circuits (the same applies to descriptions below).

At time t3, the voltage on the preceding scanning signal line Gi−1 is changed to high level, with the result that the preceding scanning signal line Gi−1 is deselected. Accordingly, the first initialization transistor T4 transitions to an OFF state. During the period from time t3 to the start of the i'th scanning selection period at time t4, the data-side drive circuit 30 starts applying a data signal D(j) to the data signal line Dj as a data voltage for the i'th-row, j'th-column pixel, and the data signal D(j) continues to be applied at least until the end of the i'th scanning selection period at time t5.

At time t4, the voltage on the corresponding scanning signal line Gi is changed from high to low level, with the result that the corresponding scanning signal line Gi is selected. Accordingly, the write control transistor T2 transitions to an ON state. Moreover, the threshold compensation transistor T3 also transitions to an ON state, and therefore the drive transistor T1 becomes diode-connected by means of gate and drain terminals thereof being connected. As a result, the voltage on the corresponding data signal line Dj, i.e., the voltage of the data signal D(j), is supplied as a data voltage Vdata to the holding capacitor Cst via the diode-connected drive transistor T1. Accordingly, the gate voltage Vg(i,j) is changed, as shown in FIG. 3, toward a value as given by equation (5) below.

$$Vg(i,j) = V\text{data} - |Vth| \quad (5)$$

Moreover, at time t4, the voltage on the corresponding scanning signal line Gi is changed from high to low level, with the result that the second initialization transistor T7 also transitions to an ON state. Accordingly, charge stored in parasitic capacitance of the organic EL element OLED is released, so that the anode voltage Va of the organic EL element is initialized to the initialization voltage Vini (see FIG. 3). It should be noted that the symbol "Va(i,j)" is used to distinguish the anode voltage Va of the pixel circuit Pix(i,j) from anode voltages Va of other pixel circuits (the same applies to descriptions below).

The period from time t4 to time t5 corresponds to a data write period for the i'th row pixel circuits Pix(i,1) to Pix(i,m), and in the pixel circuit Pix(i,j), the data voltage that has been subjected to threshold compensation as described above is written to the holding capacitor Cst during the data write period, with the result that the gate voltage Vg(i,j) takes a value as given by equation (5).

Thereafter, at time t6, the voltage on the emission control line Ei is changed to low level. Correspondingly, the first and second emission control transistors T5 and T6 transition to the ON state. Accordingly, after time t6, the current I1 flows from the high-level power line ELVDD to the low-level power line ELVSS by way of the first emission control transistor T5, the drive transistor T1, the second emission control transistor T6, and the organic EL element OLED. The current I1 is given by equation (1). Given that the drive transistor T1 is of a P-channel type and ELVDD>Vg, the current I1 is given by the following equation based on equations (1) and (5).

$$I1 = (\beta/2)(ELVDD - Vg - |Vth|)^2 = (\beta/2)(ELVDD - Vdata)^2 \quad (6)$$

Accordingly, after time t6, the organic EL element OLED emits light with a luminance corresponding to the data voltage Vdata, which is the voltage on the corresponding data signal line Dj during the i'th scanning selection period, regardless of the threshold voltage Vth of the drive transistor T1.

In the case of such display devices as the first known example, i.e., display devices that use pixel circuits configured such that data voltages are written to holding capacitors via diode-connected drive transistors after gate voltages of the drive transistors are initialized, each pixel circuit is controlled such that the organic EL element emits no light not only during the data write period for the pixel circuit (the i'th scanning selection period shown in FIG. 3) but also during the preceding reset period (the (i−1)'th scanning selection period shown in FIG. 3), with the result that no light is emitted at least during both periods, as described earlier.

<3. Configuration, Operation, and Problems of the Pixel Circuit in the Second Known Example>

In the case of the pixel circuit 15*a* in the first known example, the reset period (the period intended for initialization) is set before the data write period, as shown in FIG. 3, but there are also known pixel circuits configured such that the initialization of the gate voltage Vg of the drive transistor can be performed simultaneously with data writing, as described earlier. The configuration and operation of another known organic EL display device including such pixel circuits (referred to below as a "second known example") will be described with reference to FIGS. 4 to 6. The overall configuration of the second known example is basically the same as the configuration shown in FIG. 1, but differs in the following points. Specifically, in the second known example, the display portion 11 includes control lines 129, 125, and 127 provided along the scanning signal lines Gi, and the scanning-side drive circuit 40 generates and applies control signals GINI1[*i*], GINI2[*i*], and GP[i](where i=1 to n) to the control lines 129, 125, and 127, respectively. Moreover, as in the configuration shown in FIG. 1, the display portion 11 also includes a control line 123 corresponding to the emission control line Ei, and the control line 123 receives an emission control signal E[i](where i=1 to n) applied by the scanning-side drive circuit 40. Further, the display portion 11 includes a supply line 36 for supplying a first reference voltage VST1 and a supply line 35 for supplying a second reference voltage VST2. Still further, the display portion 11 includes m data signal lines D1 to Dm, which are divided into m/3 groups, each consisting of three data signal lines (where m is a multiple of 3). The data-side drive circuit 30 generates m/3 internal data signals S[k] (where k=1 to m/3) respectively corresponding to the m/3 data signal line groups; the data signal line G3*k*-*p* (where p is 0, 1, or 2) to which the internal data signal S[k] is applied as a data signal D[3*k*-*p*] is selected sequentially from among the three data signal lines G3*k*-2, G3*k*-1, and G3*k* in each group during each horizontal period in accordance with selection signals SEL[1] to SEL[3] generated by the display control circuit 20 (see FIG. 6). It should be noted that the second known example corresponds to the second embodiment described in Patent Document 2, but for the sake of convenience, in FIGS. 4 to 6, the names, symbols, reference characters, etc., of signals and components are suitably changed so as to clearly indicate the correspondence between the present embodiment and the second known example.

Figure 4:
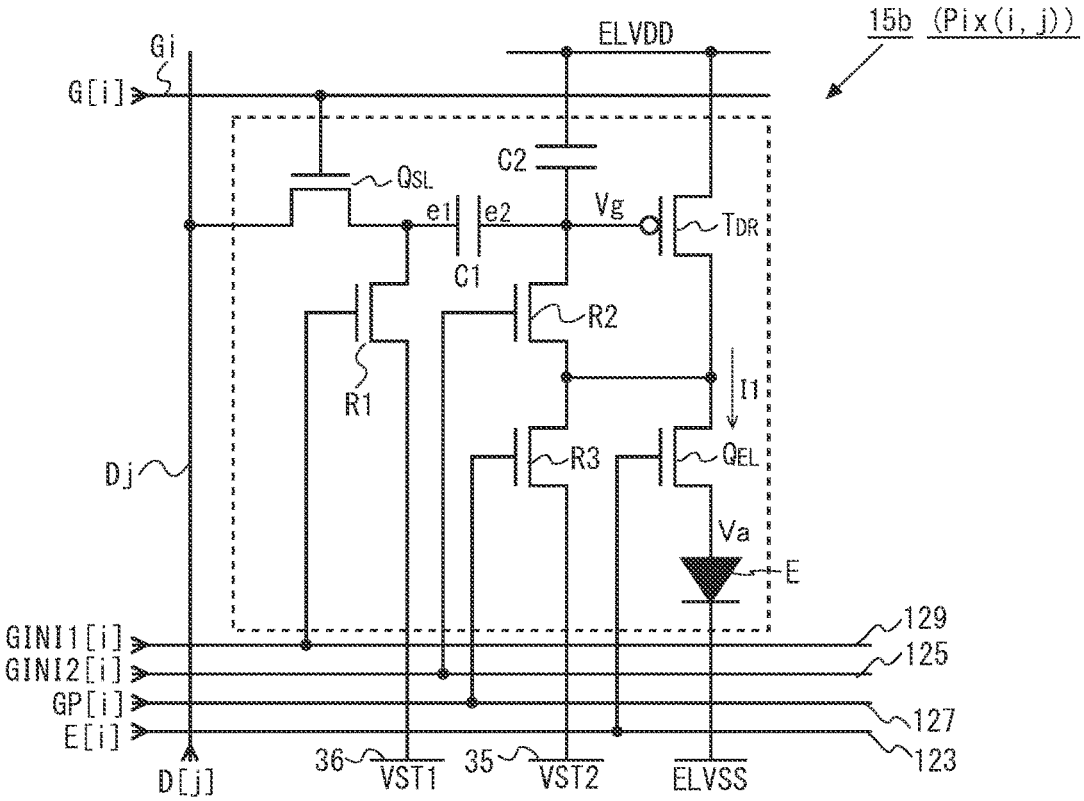
FIG. 4 Prior Art
FIG. 4 is a circuit diagram illustrating a configuration of a pixel circuit in another known display device (second known example).

The pixel circuit 15*b* in the second known example includes a light-emitting element E (corresponding to the organic EL element OLED), a P-channel drive transistor TDR, first and second capacitive elements C1 and C2, an N-channel selection transistor (write control transistor) QSL, and four N-channel transistors, which function as an emission control switch QEL, a first switch R1, a second switch R2, and a third switch R3, respectively, as shown in FIG. 4. The drive transistor TDR is connected at a source terminal to a high-level power line ELVDD and at a drain terminal to an anode of the light-emitting element E via the emission control switch QEL and also to a supply line 35 via the third switch R3. The drive transistor TDR is connected at a gate terminal to the high-level power line ELVDD via the second capacitive element C2, to a first terminal (electrode e2) of the first capacitive element C1, and to the drain terminal of the drive transistor TDR via the second switch R2. The light-emitting element E is connected at a cathode to a low-level power line ELVSS. The first capacitive element C1 is connected at a second terminal (electrode e1) to the corresponding data signal line Dj via the selection transistor QSL and to a supply line 36 via the first switch R1. Moreover, the selection transistor QSL is connected at a gate terminal to the corresponding scanning signal line Gi, the first, second, and third switches R1, R2, and R3 are connected at control terminals (gate terminals) to the respectively corresponding control lines 129, 125, and 127, and the emission control switch QEL is connected at a control terminal (gate terminal) to the corresponding control line 123.

Figure 5:
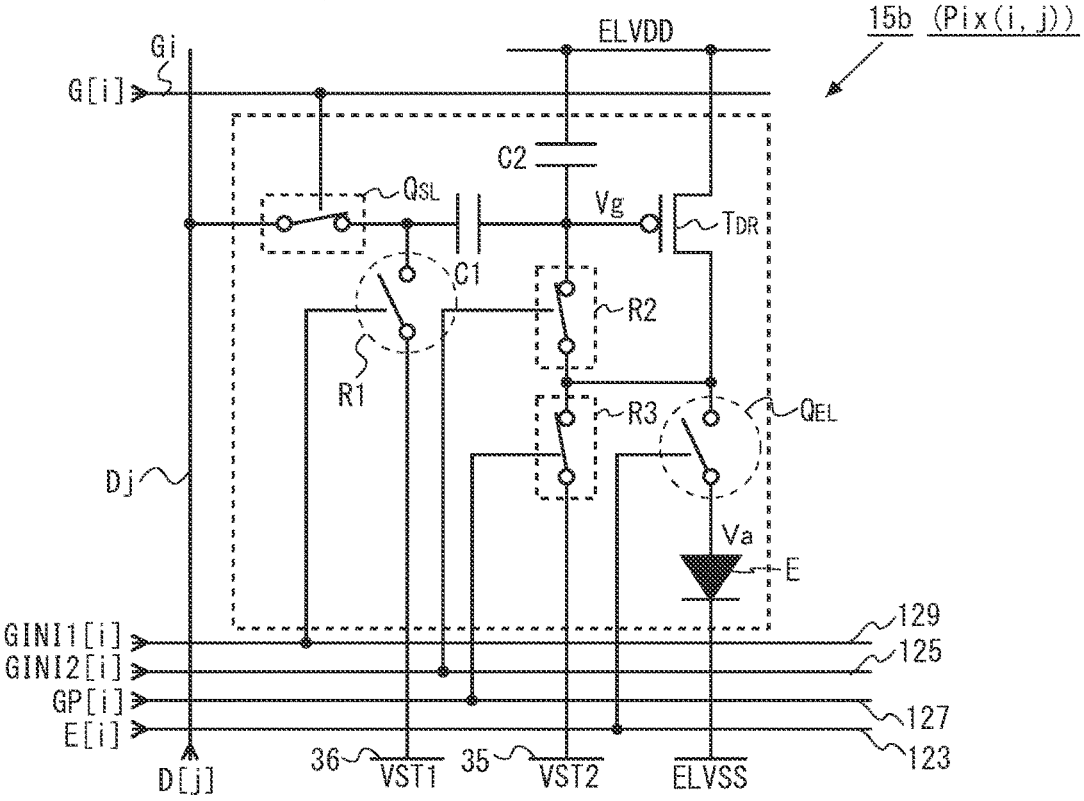
FIG. 5 Prior Art
FIG. 5 is a circuit diagram for describing initialization and data writing operations of the pixel circuit in the second known example.
Figure 6:
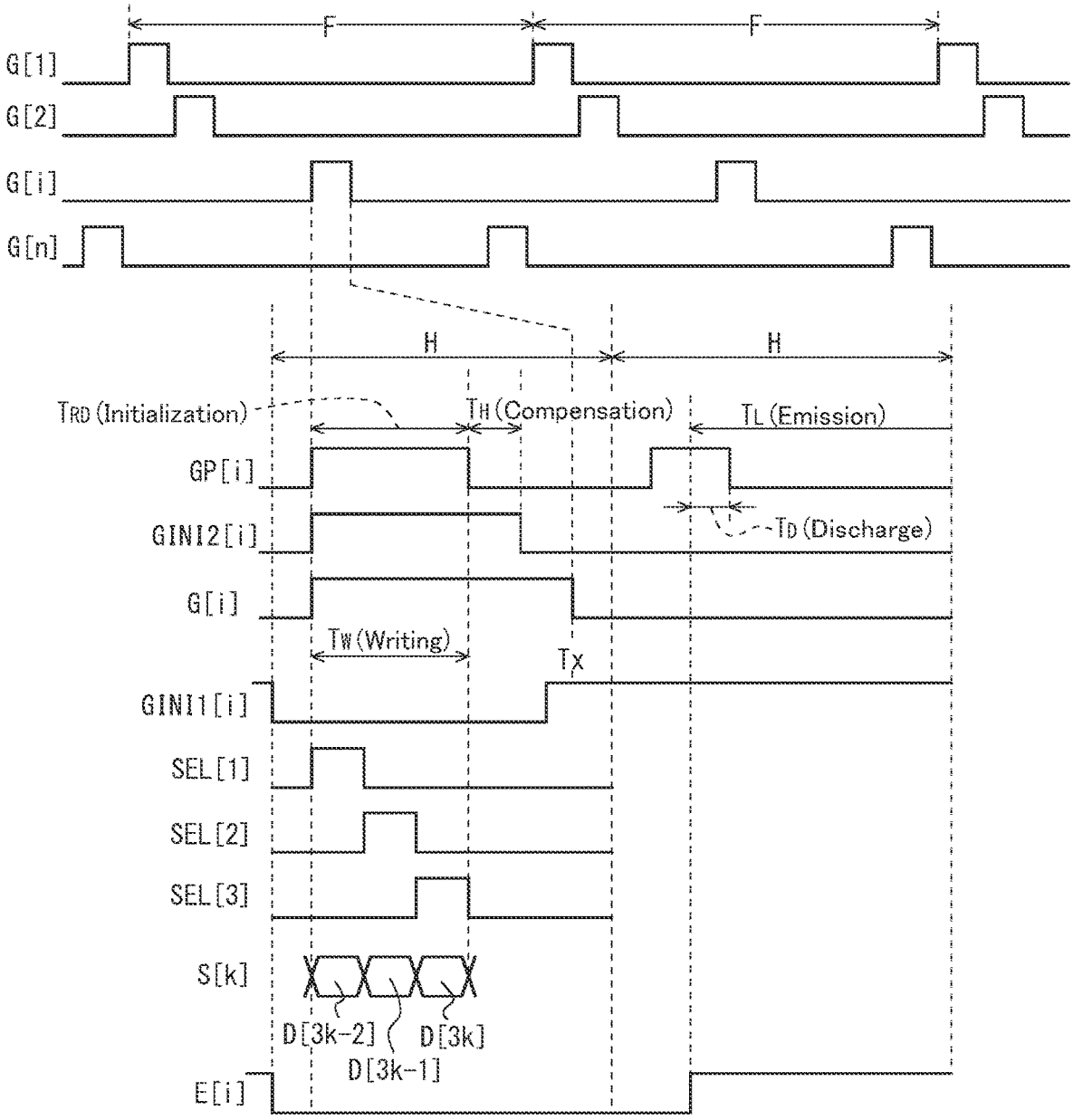
FIG. 6 Prior Art
FIG. 6 is a signal waveform diagram for describing the driving of the second known example.

The pixel circuit 15*b* thus configured and shown in FIG. 4, i.e., the i'th-row, j'th-column pixel circuit Pix(i,j), is driven by signals as shown in FIG. 6, which are a scanning signal G[i], an internal data signal S[k], an emission control signal E[i], and control signals GINI1[*i*], GINI2[*i*], and GP[i]. In the pixel circuit Pix(i,j) of the second known example, initialization and data writing are performed simultaneously (see periods TRD and Tw shown in FIG. 6); FIG. 5 shows the operation states (ON or OFF) of the switches R1 to R3 and QEL and the selection transistor QSL during this time (referred to below as the "initialization/writing period"). In FIG. 5, dotted circles enclosing transistors which serve as switching elements represent that the transistors are in an OFF state, and dotted rectangles enclosing transistors which serve as switching elements represent that the transistors are in an ON state (these representations are also used in FIG. 9 to be described later).

FIG. 6 is a signal waveform diagram for describing the driving of the display device according to the second known example and showing changes of the signals (the scanning signal G[i], the emission control signal E[i], the internal data signal S[k], the control signals GP[i], GINI1[*i*], and GINI2[*i*], and the selection signals SEL[1] to SEL[3]) during initialization, data writing, and lighting operations of the pixel circuit 15*b* shown in FIG. 4, i.e., the i'th-row, j'th-column pixel circuit Pix(i,j). It should be noted that the scanning signal G[i], the emission control signal E[i], and the data signal D[j] in the second known example respectively correspond to the signal on the scanning signal line Gi, the signal on the emission control line Ei, and the signal on the data signal line Dj in the present embodiment (where i=1 to n, and j=1 to m).

In the case of the pixel circuit Pix(i,j) of the second known example, as shown in FIG. 6, the initialization period TRD and the data write period Tw coincide with each other, and the control signals GP[i] and GINI2[*i*] and the scanning signal G[i] are at high level (active) during this time (initialization/writing period), so that the second and third switches R2 and R3 and the selection transistor QSL are in an ON state. Accordingly, the reference voltage VST2 is supplied to the gate terminal of the drive transistor TDR, thereby initializing the gate voltage Vg to the reference voltage VST2, and the data signal D[j] (the data signal D[3k-2], D[3k-1], or D[3k]) is supplied to the electrode e1 of the first capacitive element C1, thereby charging the first capacitive element C1 (i.e., data writing is performed on the basis of the data signal D[j]). It should be noted that during the initialization/writing period, the control signal GINI1[i] and the emission control signal E[i] are at low level (inactive), and therefore the first switch R1 and the emission control switch QEL are in an OFF state.

The initialization/writing period (TRD/TW) is followed immediately by a compensation period TH, and during the compensation period TH, the control signal GINI2[i] continues to be at high level, but the control signal GP[i] is at low level. Assuming that the drive transistor TDR has a threshold voltage Vth, the gate voltage Vg becomes asymptotic to the value ELVDD−|Vth| during the compensation period TH, and therefore during the following emission period, the drive transistor TDR has a gate-source voltage with a value subjected to threshold compensation.

Thereafter, the control signal GINI2[i] and the scanning signal G[i] are also changed to low level (inactive), the control signal GINI1[i] is changed to high level (active), and further thereafter the emission control signal E[i] is changed to high level (active) as the emission period TL starts. The emission period TL is followed immediately by a discharge period TD, and during the discharge period TD, the control signals GP[i] and E[i] are at high level. Accordingly, charge stored in parasitic capacitance of the light-emitting element E is released via the emission control switch QEL and the switch R3. This renders it possible to release the stored charge depending on the state of light emission during the immediately preceding frame and thereby achieve accurate gradation display in the current frame.

In the second known example as described above, for each pixel circuit 15b, the initialization of the gate voltage Vg of the drive transistor TDR is performed simultaneously with data writing (see FIGS. 5 and 6), and therefore the non-emission period can be shortened for each pixel circuit 15b compared to the first known example (see FIGS. 2 and 3). However, in the case of the pixel circuit 15b, the discharging of the parasitic capacitance of the light-emitting element E (i.e., the initialization of the anode voltage of the light-emitting element E) cannot be performed simultaneously with data writing. Accordingly, the parasitic capacitance of the light-emitting element E is discharged during the emission period TL (see the discharge period TD shown in FIG. 6). This might cause the luminance of the light-emitting element E to be unstable during the emission period TL.

<4. Configuration and Operation of the Pixel Circuit in the Present Embodiment>

Figure 7:
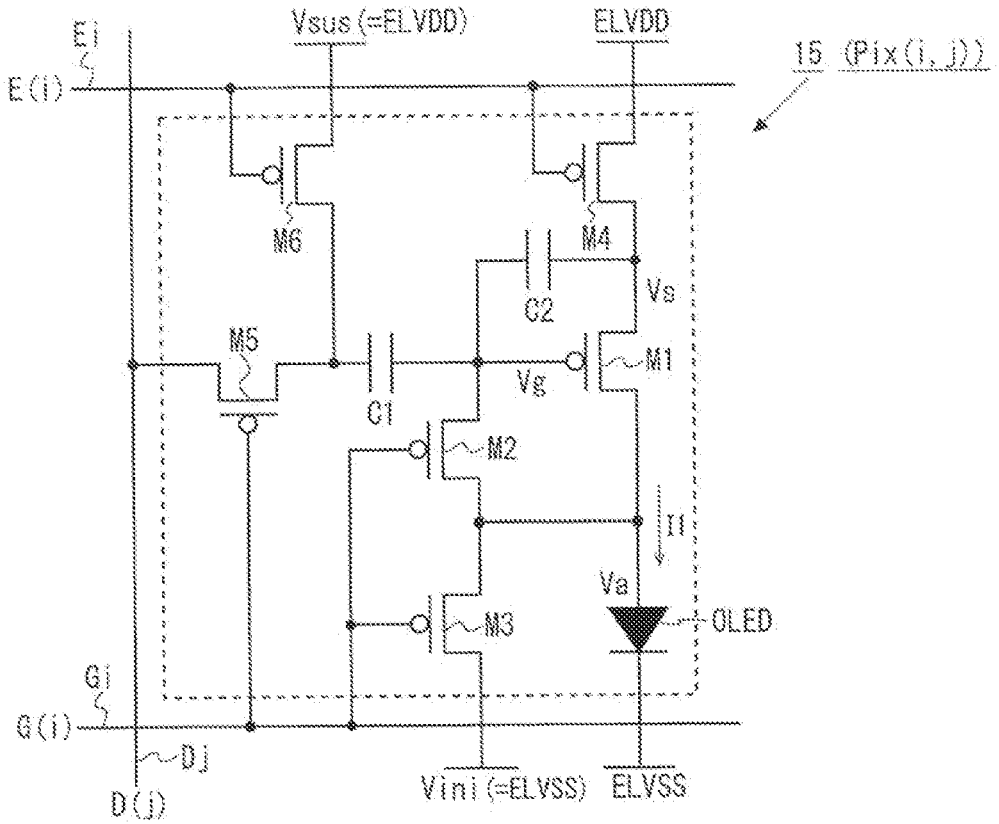
FIG. 7 is a circuit diagram illustrating a configuration of a pixel circuit in the first embodiment.

Next, the configuration and operation of the pixel circuit 15 in the present embodiment will be described with reference to FIGS. 7 to 10. FIG. 7 is a circuit diagram illustrating the configuration of the pixel circuit 15 in the present embodiment. FIG. 8 is a signal waveform diagram for describing the driving of the organic EL display device 10 according to the present embodiment. FIG. 9(A) is a circuit diagram illustrating initialization and data writing operations of the pixel circuit 15 in the present embodiment, and FIG. 9(B) is a circuit diagram illustrating a lighting operation of the pixel circuit 15. FIG. 10 is a table for describing the operation of the drive transistor during the emission period in the present embodiment and listing the amounts of charge in components of the pixel circuit in the present embodiment.

FIG. 7 illustrates the configuration of the pixel circuit 15 that corresponds to the i'th scanning signal line Gi and the j'th data signal line Dj in the present embodiment, i.e., the i'th-row, j'th-column pixel circuit Pix(i,j), (where 1≤i≤n, and 1≤j≤m). The pixel circuit 15 includes an organic EL element OLED, which serves as a display element, first and second capacitors C1 and C2, a drive transistor M1, first and second initialization transistors M2 and M3, an emission control transistor M4, and first and second write control transistors M5 and M6. In the pixel circuit 15, the transistors M2 to M6, i.e., all the transistors excluding the drive transistor M1, function as switching elements. All transistors included in the pixel circuit 15 are of a P-channel type, but a part or all of the transistors may be of an N-channel type.

The pixel circuit 15 is connected to a scanning signal line Gi corresponding thereto (a corresponding scanning signal line), an emission control line Ei corresponding to the pixel circuit (a corresponding emission control line), a data signal line Dj corresponding to the pixel circuit (a corresponding data signal line), an initialization voltage supply line Vini, a reference voltage supply line Vsus, a high-level power line ELVDD, and a low-level power line ELVSS, as shown in FIG. 7. It should be noted that the initialization voltage Vini may be a voltage different from the low-level supply voltage ELVSS, but when the initialization voltage Vini is a voltage selected to be equal to the low-level supply voltage ELVSS, it is preferable that the initialization voltage supply line Vini not be provided and the low-level power line ELVSS double as the initialization voltage supply line Vini. Moreover, the reference voltage Vsus may be a voltage different from the high-level supply voltage ELVDD, but when the reference voltage Vsus is a voltage selected to be equal to the high-level supply voltage ELVDD, it is preferable that the reference voltage supply line Vsus not be provided and the high-level power line ELVDD double as the reference voltage supply line Vsus.

As shown in FIG. 7, in the pixel circuit 15, the drive transistor M1 is connected at a source terminal, which serves as a first conduction terminal, to the high-level power line ELVDD via the emission control transistor M4. The drive transistor M1 is connected at a drain terminal, which serves as a second conduction terminal, to an anode serving as a first terminal of the organic EL element OLED. The drive transistor M1 is connected at a gate terminal, which serves as a control terminal, to the first conduction terminal via the second capacitor C2, to a first terminal of the first capacitor C1, and to the second conduction terminal via the first initialization transistor M2. The organic EL element OLED is connected at the anode to the initialization voltage supply line Vini via the second initialization transistor M3, and also at a cathode, which serves as a second terminal, to the low-level power line ELVSS. The first capacitor C1 is connected at a second terminal to the corresponding data signal line Dj via the first write control transistor M5 and to the reference voltage supply line Vsus via the second write control transistor M6. Moreover, the first write control transistor M5, the first initialization transistor M2, and the second initialization transistor M3 are connected at gate terminals to the corresponding scanning signal line Gi, and the emission control transistor M4 and the second write control transistor M6 are connected at gate terminals to the corresponding emission control line Ei. It should be noted that as can be appreciated by comparing FIG. 7 with FIG. 4, the transistors M1, M2, M3, M4, M5, and M6 included in the pixel circuit 15 in the present embodiment respectively correspond to the transistors TDR, R2, R3, QEL, QSL, and R1 included in the pixel circuit 15b in the second known example. However, while the transistor QEL serving as the emission control switch of the pixel circuit 15*b* in the second known example is connected between the drain terminal of the drive transistor TDR and the anode of the light-emitting element E, the emission control transistor M4 of the pixel circuit 15 in the present embodiment is connected between the source terminal of the drive transistor M1 and the high-level power line ELVDD.

Figure 8:
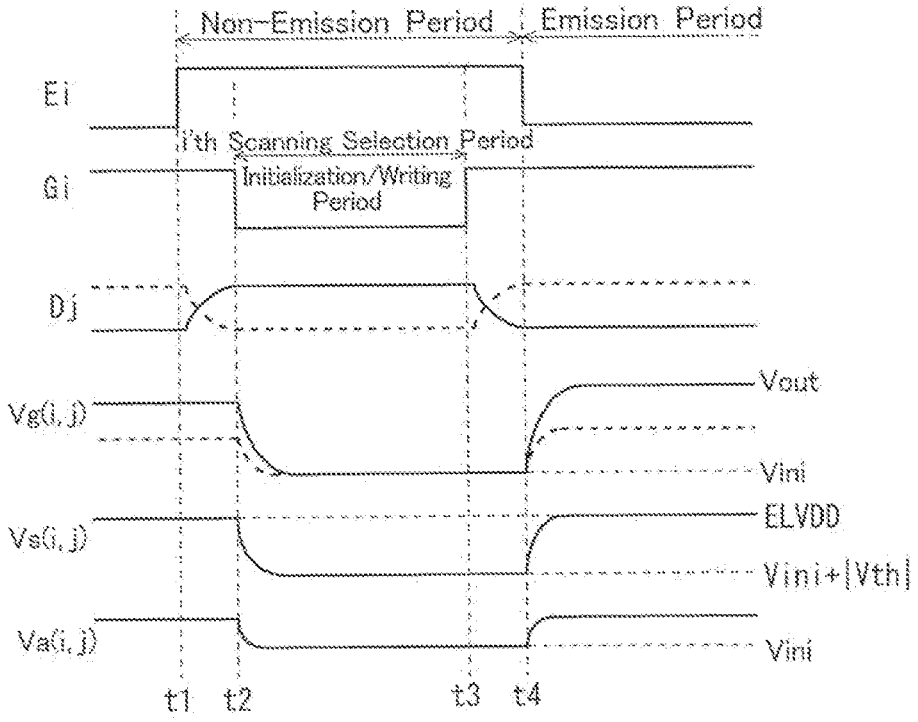
FIG. 8 is a signal waveform diagram for describing the driving of the display device according to the first embodiment.
Figure 9:
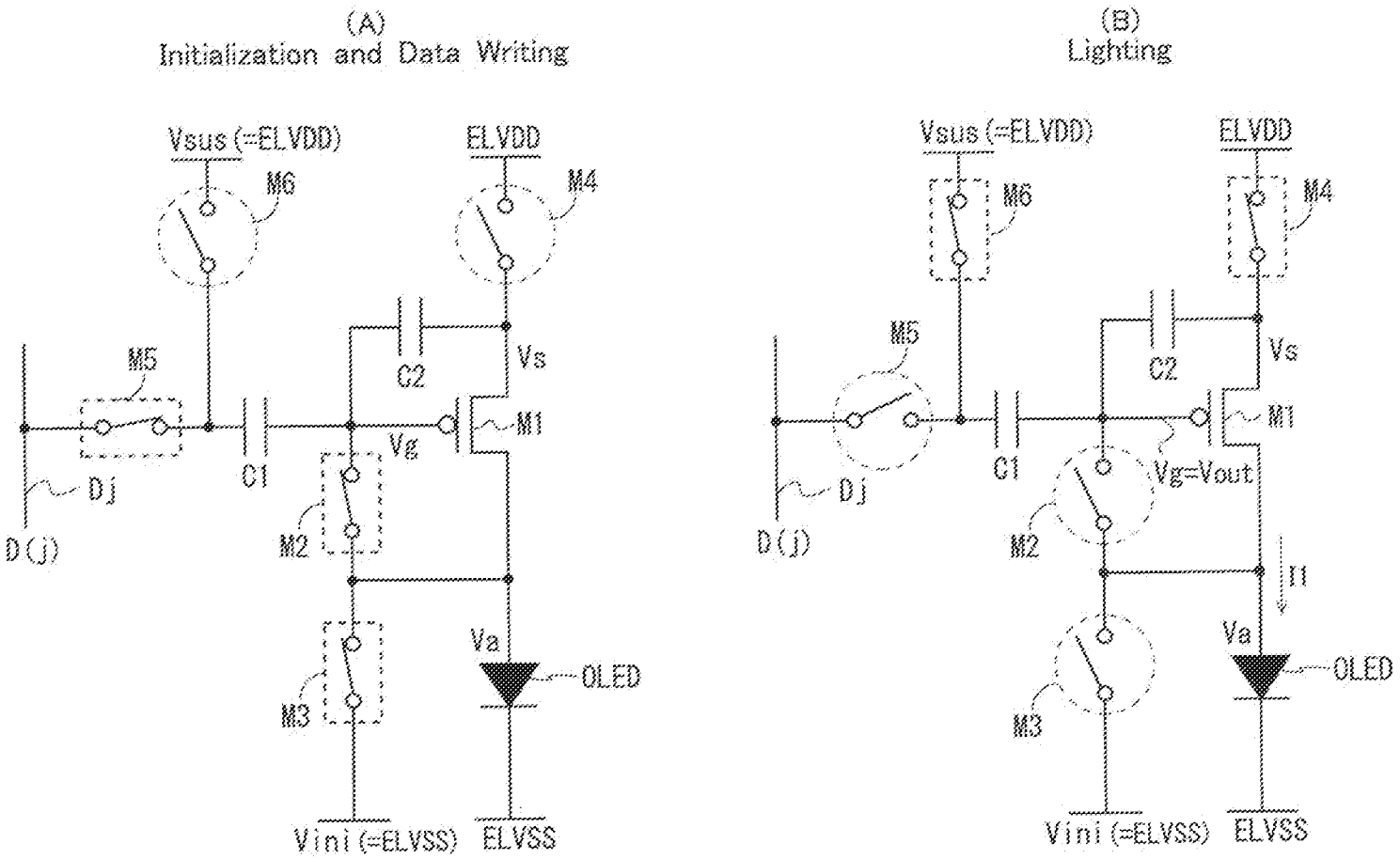
FIG. 9 provides (A) a circuit diagram illustrating initialization and data writing operations of the pixel circuit in the first embodiment and (B) a circuit diagram illustrating a lighting operation of the pixel circuit.

FIG. 8 illustrates changes in voltages during initialization, data writing, and lighting operations of the pixel circuit 15 shown in FIG. 7, i.e., the i'th-row, j'th-column pixel circuit Pix(i,j), the voltages including voltages on the signal lines (the corresponding emission control line Ei, the corresponding scanning signal line Gi, and the corresponding data signal line Dj), the gate voltage Vg of the drive transistor M1, a voltage Vs on the source terminal of the drive transistor M1 (referred to below as a "source voltage"), and a voltage Va on the anode of the organic EL element OLED (anode voltage). In FIG. 8, the period from time t1 to time t4 corresponds to a non-emission period for the i'th row pixel circuits Pix(i,1) to Pix(i,m). The period from time t2 to time t4 corresponds to the i'th horizontal period, and the period from time t2 to time t3 corresponds to a selection period for the i'th scanning signal line (corresponding scanning signal line) Gi, i.e., the i'th scanning selection period. The i'th scanning selection period corresponds to an initialization/writing period during which initialization is performed simultaneously with data writing in the i'th row pixel circuits Pix(i,1) to Pix(i,m). In the present embodiment, as for the pixel circuit Pix(i,j), the period during which the voltage on the corresponding emission control line Ei is at low level (active) and the emission control transistor M4 is in an ON state is referred to as the "emission period", and the period during which the voltage on the corresponding emission control line Ei is at high level (inactive) and the emission control transistor M4 is in an OFF state is referred to as the "non-emission period". The emission period corresponds to the period during which the organic EL element OLED is in an emission state and the non-emission period corresponds to the period during which the organic EL element OLED is in a non-emission state, but in the present embodiment, as will be described later, the emission period is slightly different from the period during which the organic EL element OLED actually emits light (hence, the non-emission period (time t1 to time t4) is also slightly different from the period during which the organic EL element OLED emits no light).

In the present embodiment, as for the i'th-row, j'th-column pixel circuit Pix(i,j), once the voltage on the emission control line Ei is changed from low to high level (inactive) at time t1, as shown in FIG. 8, the emission control transistor M4 transitions from an ON state to an OFF state, so that the organic EL element OLED is rendered in a non-emission state. At this time, the second write control transistor M6 also transitions from an ON state to an OFF state, so that the second terminal of the first capacitor C1 is rendered in a floating state. During the period from time t1 to the start of the i'th scanning selection period at time t2, the data-side drive circuit 30 starts applying a data signal D(j), which is a data voltage corresponding to the i'th-row, j'th-column pixel, to the data signal line Dj, and the data signal D(j) continues to be applied at least until the end of the i'th scanning selection period at time t3.

At time t2, the voltage on the corresponding scanning signal line Gi is changed from high to low level (active), as shown in FIG. 8, with the result that the corresponding scanning signal line Gi is selected. Accordingly, the first write control transistor M5 transitions from an OFF state to an ON state. At this time, the first and second initialization transistors M2 and M3 also transition from an OFF state to an ON state.

The period from time t2 to time t3 is the initialization/writing period for the i'th row pixel circuits Pix(i,1) to Pix(i,m), as described earlier, and during the initialization/writing period, the first and second initialization transistors M2 and M3 and the first write control transistor M5 are in an ON state. FIG. 9(A) schematically illustrates the state of the pixel circuit Pix(i,j) during the initialization/writing period, i.e., the state of the circuit where initialization and data writing are simultaneously performed. During the initialization/writing period, the voltage on the initialization voltage supply line Vini is supplied to the gate terminal of the drive transistor M1 via the first and second initialization transistors M2 and M3, with the result that the gate voltage Vg is initialized to the initialization voltage Vini, as shown in FIG. 8. Moreover, during the initialization/writing period, the voltage on the corresponding data signal line Dj is supplied to the second terminal of the first capacitor C1 via the first write control transistor M5 as a data voltage Vdata. As a result, the amount of charge stored in the first capacitor C1 (the amount of charge on the gate terminal of the drive transistor M1) becomes C1(Vini−Vdata) at the end of the initialization/writing period, as shown in FIG. 10.

During the emission period within the immediately preceding frame period, the second capacitor C2 normally holds a voltage higher than the absolute value |Vth| of the threshold voltage of the drive transistor M1, and during the period from time t1 to time t2, since the transistors M2, M4, M5, and M6 are in the OFF state, the voltage held by the second capacitor C2 (i.e., the held voltage with reference to the voltage on the gate terminal of the drive transistor M1) is maintained, and the drive transistor M1 is in an ON state. During the initialization/writing period (time t2 to time t3), the source terminal of the drive transistor M1 is electrically disconnected from the high-level power line ELVDD by the emission control transistor M4 in the OFF state, and the drive transistor M1 is diode-connected with the gate and drain terminals thereof being electrically connected via the first initialization transistor M2 in an ON state. This results in a compensation operation for inhibiting the gate-source voltage of the drive transistor M1 from being affected by variations and shifts in the threshold voltage Vth during the following emission period. Moreover, since the source terminal of the drive transistor M1 is electrically disconnected from the high-level power line ELVDD during the initialization/writing period, and further the gate terminal of the drive transistor M1 is electrically connected to the initialization voltage supply line Vini via the first and second initialization transistors M2 and M3 in the ON state, it can be said that this also contributes to the compensation operation. The compensation operation during the initialization/writing period is intended to cause the second capacitor C2 to hold a voltage equal to the threshold voltage of the drive transistor M1, as specifically described below. The gate terminal of the drive transistor M1 is connected to the initialization voltage supply line Vini and the drain terminal of the drive transistor M1 at time t2, with the result that charge stored in the second capacitor C2 flows out and a current starts flowing into the drive transistor M1. The flowing out of the stored charge from the second capacitor C2 reduces the voltage that is being held by the second capacitor C2, and stops when the held voltage becomes equal to the absolute value |Vth| of the threshold voltage of the drive transistor M1. In this manner, during the initialization/writing period (time t2 to time t3), the charge stored in the second capacitor C2 in accordance with the emission state during the immediately preceding frame flows out through the drive transistor M1 while the voltage that is being held by the second capacitor C2 is greater than the absolute value |Vth| of the threshold voltage of the drive transistor M1, and the flowing out of the charge stops when the voltage that is being held by the second capacitor C2 becomes equal to the absolute value |Vth| of the threshold voltage. As a result, the amount of charge stored in the second capacitor C2 (the amount of charge on the gate terminal of the drive transistor M1) becomes −C2|Vth| at the end of the initialization/writing period, as shown in FIG. 10. Accordingly, the second capacitor C2 is charged to the voltage |Vth| with reference to the voltage on the gate terminal of the drive transistor M1.

Furthermore, during the initialization/writing period, the anode of the organic EL element OLED is electrically connected to the initialization voltage supply line Vini via the second initialization transistor M3, and therefore charge stored in parasitic capacitance of the organic EL element OLED is released, with the result that the anode voltage Va is also initialized to the initialization voltage Vini, as shown in FIG. 8. It should be noted that since the anode voltage Va is initialized to the initialization voltage Vini (=ELVIS), the organic EL element OLED emits no light during the initialization/writing period regardless of whether there is an emission control transistor.

At the end of the i'th scanning selection period, i.e., the initialization/writing period, at time t3, the voltage on the corresponding scanning signal line Gi is changed to high level, with the result that the first and second initialization transistors M2 and M3 and the first write control transistor M5 transition to an OFF state.

Thereafter, at time t4, the voltage on the emission control line Ei is changed to low level. As a result, the emission control transistor M4 is rendered in an ON state, and the emission period is started. Moreover, at this time, the second write control transistor M6 transitions to an ON state, so that the reference voltage Vsus is applied to the second terminal of the first capacitor C1. In the pixel circuit Pix(i,j), the emission control transistor M4 and the second write control transistor M6 are in the ON state during the emission period, which starts at time t4, as described above, and the first initialization transistor M2, the second initialization transistor M3, and the first write control transistor M5 are in the OFF state. When the emission control transistor M4 transitions from the OFF state to the ON state at the start of the emission period at time t4, as described above, the gate terminal of the drive transistor M1 is electrically disconnected from the initialization voltage supply line Vini, the high-level supply voltage ELVDD is supplied to the source terminal of the drive transistor M1, and the reference voltage Vsus is supplied to the second terminal of the first capacitor C1. As a result, charge transfer occurs between the first capacitor C1 and the second capacitor C2, with the result that the second capacitor C2 holds a voltage corresponding to a voltage obtained by subjecting the voltage on the corresponding data signal line to threshold compensation based on the voltage held by the second capacitor C2 at a time point immediately before the emission period (i.e., immediately before time t4). Accordingly, when the emission period starts, the organic EL element OLED does not immediately emit light with a desired luminance (the luminance corresponding to the voltage on the corresponding data signal line), but is gradually changed from a black display state to an emission state with the desired luminance in accordance with the charge transfer. FIG. 9(B) schematically illustrates the state of the pixel circuit Pix(i,j) during the emission period, i.e., the state of the circuit during the lighting operation. During the emission period, a current I1 flows from the high-level power line ELVDD to the low-level power line ELVSS via the emission control transistor M4, the drive transistor M1, and the organic EL element OLED. The current I1 corresponds to the voltages held by the first and second capacitors C1 and C2 at the end of the initialization/writing period at time t3, and can be represented by an equation derived as described below.

As described earlier, the amounts of charge stored in the first and second capacitors C1 and C2 are C1(Vini−Vdata) and −C2|Vth|, respectively, at the end of the initialization/writing period at time t3, and therefore the amount of charge Qg(t3) on a node which includes the gate terminal of the drive transistor M1 (referred to below as a "node G") at the end of the initialization/writing period at time t3 is:

$$Qg(t3)=C1(Vini-V\text{data})-C2|Vth| \quad (7).$$

On the other hand, where the gate voltage Vg during the emission period is denoted by Vout, the amounts of charge in the first and second capacitors C1 and C2 are C1(Vout−Vsus) and C2(Vout−ELVDD), respectively, during the emission period. Accordingly, the amount of charge Qg(te) on the node G during the emission period is:

$$Qg(te)=C1(V\text{out}-V\text{sus})+C2(V\text{out}-\text{ELVDD}) \quad (8)$$

(where te denotes a point in time within the emission period (te>T4)). According to charge conservation law for the node G, Qg(t3)=Qg(te), and therefore the following can be derived from equations (7) and (8):

$$C1(Vini-V\text{data})-C2Vth=C1(V\text{out}-V\text{sus})+C2(V\text{out}-\text{ELVDD}).$$

Therefore, the gate voltage Vg=Vout during the emission period can be given by the following equation.

$$V\text{out}=\{C1/(C1+C2)\}(Vini-V\text{data}+V\text{sus})+\{C2/(C1+C2)\}(\text{ELVDD}-Vth) \quad (9)$$

From equation (9), the gate-source voltage Vgs of the drive transistor M1 (i.e., the voltage on the gate terminal with reference to the voltage on the source terminal) is derived to be as follows:

$$\begin{aligned} Vgs &= Vout - ELVDD \quad (10) \\ &= \{C1/(C1+C2)\}(Vini - Vdata + Vsus - ELVDD) - \\ &\quad \{C2/(C1+C2)\}|Vth| \end{aligned}$$

As in the first known example, the current I1 during the emission period is given by equation (1) described earlier. Accordingly, by assigning Vg=Vout expressed by equation (9) to equation (1), or by assigning equation (10) to equation (1), the current I1 is derived to be as follows:

$$I1=(\beta/2)[\{C1/(C1+C2)\}(V\text{data}-Vini-|Vth|-V\text{sus}+\text{ELVDD})]^2 \quad (11)$$

During the emission period, the organic EL element OLED in the pixel circuit Pix(i,j) emits light with a luminance in accordance with the current I1 expressed by equation (11).

<5. Effects>

In the present embodiment, as in the second known example, the initialization of the gate voltage Vg of the drive transistor M1 is performed simultaneously with data writing (FIGS. 8 and 9(A)), as described above, and therefore when compared to the first known example (FIGS. 2 and 3), the non-emission period can be shortened for each pixel circuit Pix(i,j), and the pixel circuit Pix(i,j) is not required to be connected to the preceding scanning signal line Gi−1. Moreover, in the present embodiment, unlike in the second known example (see FIG. 6), the compensation operation for causing the second capacitor C2 to hold a voltage equal to the threshold voltage of the drive transistor M1 is also performed simultaneously with the initialization and the data writing, and therefore the present embodiment is more advantageous in shortening the non-emission period than the second known example. Further, in the present embodiment, unlike in the second known example, the initialization of the anode voltage Va of the organic EL element OLED, also, is performed simultaneously with data writing (FIGS. 8 and 9(A)). Accordingly, unlike in the second known example, in which the anode voltage of the light-emitting element E is initialized during the emission period TL (see the discharge period TD shown in FIG. 6), the initialization of the anode voltage Va does not cause the luminance of the organic EL element OLED to be unstable. Moreover, the scanning signal G(i), as used as the control signal for the first initialization transistor M2, is also used as the control signal for the second initialization transistor M3 in order to initialize the anode voltage Va (see FIG. 7), and therefore wiring areas for control signals can be reduced compared not only to the first known example but also to the second known example.

In the present embodiment, the current I1, which flows through the organic EL element OLED in the pixel circuit Pix(i,j) during the emission period, is as expressed by equation (11), which includes a term for |Vth|. However, the term for |Vth| bracketed in equation (1) for the current I1 in the first known example is "—|Vth|", whereas the term for |Vth| in the square brackets in equation (11) for the current I1 in the present embodiment is "−{C1/(C1+C2)}Vth|". Accordingly, in the present embodiment, the capacitance values of the first and second capacitors C1 and C2 can be set so as to sufficiently minimize the effect of the threshold voltage Vth on the drive current I1 of the organic EL element OLED. Therefore, by suitably setting the capacitance values of the first and second capacitors C1 and C2, variations and shifts in the threshold voltage Vth during the lighting operation can be substantially compensated for. Moreover, the term for the data voltage Vdata in the square brackets in equation (11) is "{C1/(C1+C2)}Vdata", which includes the coefficient C1/(C1+C2), and therefore even if the data voltage Vdata is changed significantly, the drive current I1 of the organic EL element OLED, which serves as a display element, is changed relatively insignificantly. Thus, the present embodiment renders it possible to achieve enhanced gradation control.

In the present embodiment, the organic EL element OLED does not emit light with a desired luminance immediately at the start of the emission period, but the organic EL element OLED gradually changes from a black display state to an emission state with a desired luminance, as described earlier. Accordingly, when an image is displayed, a black screen is inserted by virtue of the non-emission period and also by allowing the organic EL element OLED to gradually transition from the black display state to the emission state with a desired luminance at the start of the emission period (i.e., at the time when the voltage on the corresponding emission control line Ei is changed to low level). Accordingly, even if the black screen inserted by virtue of the non-emission period appears only for a short period of time, the black screen inserted by the gradual state transition of the organic EL element OLED ensures a sufficient black display period, whereby satisfactory video display performance can be achieved.

<6. Variants>

The disclosure is not limited to the embodiment, and various modifications can also be made without departing from the scope of the disclosure. For example, as described earlier, the voltage that is equal to the low-level supply voltage ELVSS may be selected as the initialization voltage Vini, and the low-level power line ELVSS may double as the initialization voltage supply line Vini. Moreover, as described earlier, the voltage that is equal to the high-level supply voltage ELVDD may be selected as the reference voltage Vsus, and the high-level power line ELVDD may double as the reference voltage supply line Vsus. These configurations render it possible to reduce the wiring area of the display portion 11.

Furthermore, in the embodiment, the initialization/writing period (time t2 to time t3) or the emission period can be lengthened by shortening the period from the end of the initialization/writing period (i.e., the i'th scanning selection period) at time t3 to the start of the emission period at time t4 as much as possible, but not to such an extent that the pixel circuit 15 operates incorrectly or malfunctions. Moreover, the initialization/writing period (time t2 to time t3) or the emission period can also be lengthened by shortening the period from the start of the non-emission period at time t1 to the start of the initialization/writing period (i.e., the i'th scanning selection period) at time t2 as much as possible, but not to such an extent that the pixel circuit 15 operates incorrectly or malfunctions. Further, the emission period can be lengthened by shortening the period from time t1 to time t2 and the period from time t3 to time t4 as much as possible, but not to such an extent that the pixel circuit 15 operates incorrectly or malfunctions, and thereby shortening as much as possible the period during which the organic EL element OLED is in a non-emission state, i.e., the period during which a black screen is inserted, (or setting such a black screen insertion period approximately equal to the initialization/writing period).

Figure 11:
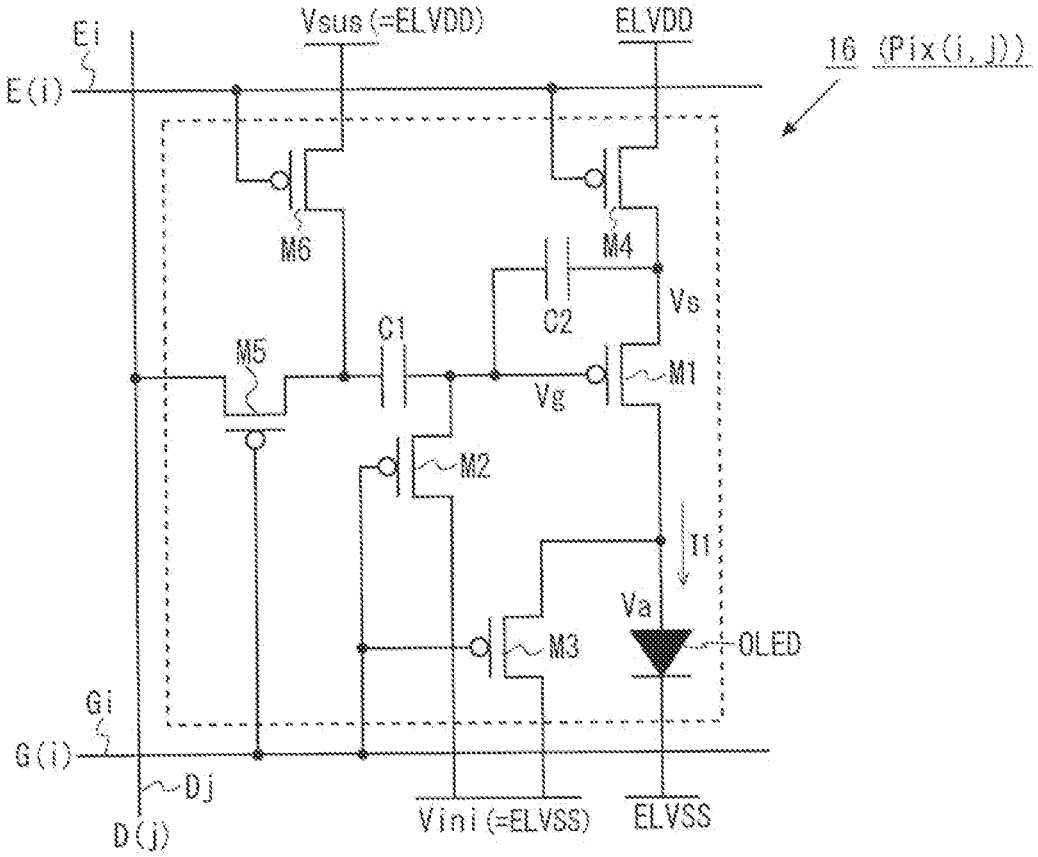
FIG. 11 is a circuit diagram illustrating a configuration of a pixel circuit in a variant of the first embodiment.

Furthermore, in the pixel circuit 15 in the embodiment, the gate terminal of the drive transistor M1 is connected to the drain terminal of the drive transistor M1 via the first initialization transistor M2 and to the initialization voltage supply line Vini via the first and second initialization transistors M2 and M3, as shown in FIG. 7. However, instead of this, the gate terminal of the drive transistor M1 may be connected to the initialization voltage supply line Vini solely via the first initialization transistor M2, as shown in FIG. 11. In the case of a display device which uses a pixel circuit 16 shown in FIG. 11, the drive transistor M1 is diode-connected by the first and second initialization transistors M2 and M3 during the initialization/writing period, and in this regard, such a device is different from the embodiment, in which the drive transistor M1 is diode-connected solely by the first initialization transistor M2, but the device operates substantially in the same manner as the embodiment (see FIG. 8) and thereby achieves the same effects.

Furthermore, while the embodiment and the variants thereof have been described above taking as an example the organic EL display device, the disclosure is not limited to the organic EL display device and can be applied to any display devices, so long as the display devices employ internal compensation using current-driven display elements. Display elements that can be used are those whose luminance, transmittance, etc., are controlled by currents, and in addition to organic EL elements, or organic light-emitting diodes (OLEDs), examples of the display elements include inorganic light-emitting diodes and quantum-dot light-emitting diodes (QLEDs).

DESCRIPTION OF THE REFERENCE CHARACTERS

10 organic EL display device
11 display portion
15, 16 pixel circuit
Pix(i,j) pixel circuit (i=1 to n; j=1 to m)
20 display control circuit
30 data-side drive circuit (data signal line drive circuit)
40 scanning-side drive circuit (scanning signal line drive circuit/emission control circuit)
Gi scanning signal line (i=1 to n)
Ei emission control line (i=1 to n)
Dj data signal line (j=1 to m)
Vini initialization voltage supply line, initialization voltage
Vsus reference voltage supply line, reference voltage
ELVDD high-level power line (first power line), high-level supply voltage
ELVSS low-level power line (second power line), low-level supply voltage
OLED organic EL element (display element)
C1 first capacitor
C2 second capacitor
M1 drive transistor
M2 first initialization transistor (first initialization switching element)
M3 second initialization transistor (second initialization switching element)
M4 emission control transistor (emission control switching element)
M5 first write control transistor (first write control switching element)
M6 second write control transistor (second write control switching element)
Va anode voltage
Vg gate voltage
Vs source voltage

The invention claimed is:

1. A display device having a plurality of data signal lines, a plurality of scanning signal lines crossing the data signal lines, a plurality of emission control lines corresponding to the respective scanning signal lines, and a plurality of pixel circuits arranged in a matrix along the data signal lines and the scanning signal lines, the device comprising:
- first and second power lines;
- an initialization voltage supply line;
- a reference voltage supply line;
- a data signal line drive circuit configured to drive the data signal lines;
- a scanning signal line drive circuit configured to selectively drive the scanning signal lines; and
- an emission control circuit configured to drive the emission control lines, wherein,
- each pixel circuit includes:
  - a display element driven by a current;
  - first and second capacitors;
  - a drive transistor configured to control the drive current of the display element in accordance with voltages held by the first and second capacitors; and
  - an emission control switching element,
- the drive transistor is connected at a first conduction terminal to the first power line via the emission control switching element,
- the drive transistor is connected at a second conduction terminal to a first terminal of the display element,
- the drive transistor is connected at a control terminal to the first conduction terminal via the second capacitor and to a first terminal of the first capacitor,
- the display element is connected at a second terminal to the second power line,
- each pixel circuit corresponds to one of the data signal lines and one of the scanning signal lines, and
- each pixel circuit is configured such that upon writing of a voltage on the corresponding data signal line to the pixel circuit,
  - the emission control switching element is controlled to be in an OFF state, and
  - in response to selection of the corresponding scanning signal line, a second terminal of the first capacitor is supplied with the voltage on the corresponding data signal line, and the control terminal of the drive transistor and the first terminal of the display element are supplied with a voltage on the initialization voltage supply line.

2. The display device according to claim 1, wherein in each pixel circuit, when the emission control switching element is controlled to be in the OFF state and the corresponding scanning signal line is selected, the voltage on the initialization voltage supply line is supplied to the control terminal of the drive transistor and the first terminal of the display element, and the voltage on the corresponding data signal line is supplied to the second terminal of the first capacitor, whereby the first capacitor holds a voltage corresponding to a difference between the voltage on the corresponding data signal line and the voltage on the initialization voltage supply line, and the second capacitor holds a threshold voltage detected for the drive transistor.

3. The display device according to claim 1, wherein each pixel circuit is configured such that, when the display element in the pixel circuit is driven in accordance with the voltages held by the first and second capacitor, the control terminal of the drive transistor and the first terminal of the display element are electrically disconnected from the initialization voltage supply line, the second terminal of the first capacitor is supplied with a voltage on the reference voltage supply line, and the emission control switching element is controlled to be in an ON state.

4. The display device according to claim 3, wherein in each pixel circuit, when the control terminal of the drive transistor and the first terminal of the display element are electrically disconnected from the initialization voltage supply line, and the emission control switching element is controlled to transition from the OFF state to the ON state, the first conduction terminal of the drive transistor is supplied with a voltage on the first power line, and the second terminal of the first capacitor is supplied with the voltage on the reference voltage supply line, whereby charge transfer occurs between the first capacitor and the second capacitor such that the second capacitor holds a voltage corresponding to the voltage on the corresponding data signal line.

5. The display device according to claim 3, wherein in each pixel circuit, when the control terminal of the drive transistor and the first terminal of the display element are electrically disconnected from the initialization voltage supply line, and the emission control switching element is controlled to transition from the OFF state to the ON state, the display element gradually transitions from a black display state to an emission state with a luminance corresponding to the voltage on the corresponding data signal line.

6. The display device according to claim 1, wherein, each pixel circuit further includes first and second write control switching elements, and in each pixel circuit, the second terminal of the first capacitor is connected to the corresponding data signal line via the first write control switching element and to the reference voltage supply line via the second write control switching element.

7. The display device according to claim 1, wherein, each pixel circuit further includes first and second initialization switching elements, and in each pixel circuit, the control terminal of the drive transistor is connected to the second conduction terminal via the first initialization switching element, and the first terminal of the display element is connected to the initialization voltage supply line via the second initialization switching element.

8. The display device according to claim 7, wherein, each pixel circuit further includes first and second write control switching elements, and in each pixel circuit, the second terminal of the first capacitor is connected to the corresponding data signal line via the first write control switching element and to the reference voltage supply line via the second write control switching element, the first write control switching element, the first initialization switching element, and the second initialization switching element are connected at control terminals to the corresponding scanning signal line, and the second write control switching element and the emission control switching element are connected at control terminals to an emission control line corresponding to the corresponding scanning signal line.

9. The display device according to claim 8, wherein, the scanning signal line drive circuit applies a plurality of scanning signals to the respective scanning signal lines, the scanning signals being sequentially activated so as to sequentially select the scanning signal lines, and for each of the scanning signal lines, the emission control circuit applies an emission control signal to an emission control line corresponding to the scanning signal line, the emission control signal being inactive during a non-emission period including a selection period for the scanning signal line, and active during an emission period including selection periods for any other scanning signal lines.

10. The display device according to claim 1, wherein the second power line doubles as the initialization voltage supply line.

11. The display device according to claim 1, wherein the first power line doubles as the reference voltage supply line.

12. The display device according to claim 1, wherein, the first power line is a high voltage power line, the second power line is a low voltage power line, and the drive transistor is a P-channel transistor.

13. A method for driving a display device having a plurality of data signal lines, a plurality of scanning signal lines crossing the data signal lines, a plurality of emission control lines corresponding to the respective scanning signal lines, first and second power lines, an initialization voltage supply line, a reference voltage supply line, and a plurality of pixel circuits arranged in a matrix along the data signal lines and the scanning signal lines, wherein, each pixel circuit corresponds to one of the data signal lines and one of the scanning signal lines, and each pixel circuit includes a display element driven by a current, first and second capacitors, a drive transistor configured to control the drive current of the display element in accordance with voltages held by the first and second capacitors, and an emission control switching element, the drive transistor is connected at a first conduction terminal to the first power line via the emission control switching element, the drive transistor is connected at a second conduction terminal to a first terminal of the display element, the drive transistor is connected at a control terminal to the first conduction terminal via the second capacitor and to a first terminal of the first capacitor, the display element is connected at a second terminal to the second power line, and the method comprises a data writing step of, upon writing of a voltage on a corresponding data signal line to each pixel circuit, controlling the emission control switching element in the pixel circuit to be in an OFF state, supplying the voltage on the corresponding data signal line to a second terminal of the first capacitor, and supplying a voltage on the initialization voltage supply line to the control terminal of the drive transistor and the first terminal of the display element.

14. The method according to claim 13, wherein in the data writing step, the second capacitor is charged to a voltage corresponding to a threshold voltage of the drive transistor, and the first capacitor is charged to a voltage corresponding to a difference between the voltage on the corresponding data signal line and the voltage on the initialization voltage supply line.

15. The method according to claim 13, further comprising a lighting step of, when driving the display element in accordance with the voltages held by the first and second capacitors, electrically disconnecting the control terminal of the drive transistor and the first terminal of the display element from the initialization voltage supply line, supplying a voltage on the reference voltage supply line to the second terminal of the first capacitor, and controlling the emission control switching element to be in an ON state.

16. The method according to claim 15, wherein in the lighting step, the drive transistor has a voltage Vgs between the control terminal and the first conduction terminal, the voltage Vgs having a value expressed by the following equation:

$$Vgs=\{C1/(C1+C2)\}(Vini-V\text{data}+V\text{sus}-\text{ELVDD})-\{C2/(C1+C2)\}|Vth|,$$

where C1 is a capacitance value of the first capacitor, C2 is a capacitance value of the second capacitor, Vdata is the voltage on the corresponding data signal line, Vini is the voltage on the initialization voltage supply line, Vsus is the voltage on the reference voltage supply line, ELVDD is a voltage on the first power line, and Vth is the threshold voltage of the drive transistor.

* * * * *